United States Patent [19]

Kaneko

[11] Patent Number: 4,514,884

[45] Date of Patent: May 7, 1985

[54] DOUBLE-SLIDER FASTENING LOCK

[76] Inventor: Katsukichi Kaneko, 2-20-9, Daito-ku, Tokyo, Japan

[21] Appl. No.: 406,163

[22] Filed: Aug. 9, 1982

[30] Foreign Application Priority Data

Dec. 21, 1981 [JP] Japan ..... 56-189350[U]

[51] Int. Cl.[3] ..... E05B 67/38; A44B 19/26

[52] U.S. Cl. ..... 24/386; 24/387; 70/68

[58] Field of Search ..... 24/386, 387, 425, 436; 70/68

[56] References Cited

U.S. PATENT DOCUMENTS

| | | | |
|---|---|---|---|
| 1,907,778 | 5/1933 | Freysinger | 70/68 X |
| 3,971,458 | 7/1976 | Koenig | 24/387 X |
| 4,015,457 | 4/1977 | Fukuroi | 24/386 X |
| 4,244,086 | 1/1981 | Gregg | 70/68 X |
| 4,350,375 | 9/1982 | Bako | 24/386 X |
| 4,395,891 | 8/1983 | Remington | 70/68 |

*Primary Examiner*—Francis K. Zugel
*Assistant Examiner*—Peter A. Aschenbrenner
*Attorney, Agent, or Firm*—Fleit, Jacobson, Cohn & Price

[57] ABSTRACT

The invention relates more particularly to a double-slider fastening lock including a catch plate having a long hole capable of inserting a head of a corresponding slider, a cover body having several windows on the side portion and having a hole corresponding to the long hole the upper portion, the cover body covering an upper surface of the catch plate and being fixed on the catch plate, a hook-shaped hook plate having a projection on its back and being inserted slidably in the direction crossing at right angles with the axis along the hole of the cover body, and a sliding plate having a projection capable of engaging with the projection of the hook plate on the front and being formed to be inserted slidably in the axial direction of the cover body.

4 Claims, 7 Drawing Figures

DOUBLE-SLIDER FASTENING LOCK

BRIEF SUMMARY OF THE INVENTION

The present invention relates to a double-slider fastening lock capable of fastening a lock simply and certainly on a slider of a slide fastener equipped at an opening portion of a suitcase, and more particularly to a lock for fastener use, characterized in that a catch plate having a long hole capable of inserting a head of a corresponding other slider, a cover body having several windows on the side portion and having a hole corresponding to said long hole located in the upper portion, said cover body covering an upper surface of said catch plate and being fixed on said catch plate, a hook-shaped hook plate having a projection on its back and being inserted slidably in the direction crossing at right angles with the axis along said hole of the cover body, and a sliding plate having knobs capable of projecting from side windows of the cover body on both ends together with having a projection capable of engaging with the projection of said hook plate and being inserted slidably in the axial direction of the cover body, further the hook plate and sliding plate are constituted to be energized to a fixed direction by a spring.

DETAILED DESCRIPTION

Figure 1:
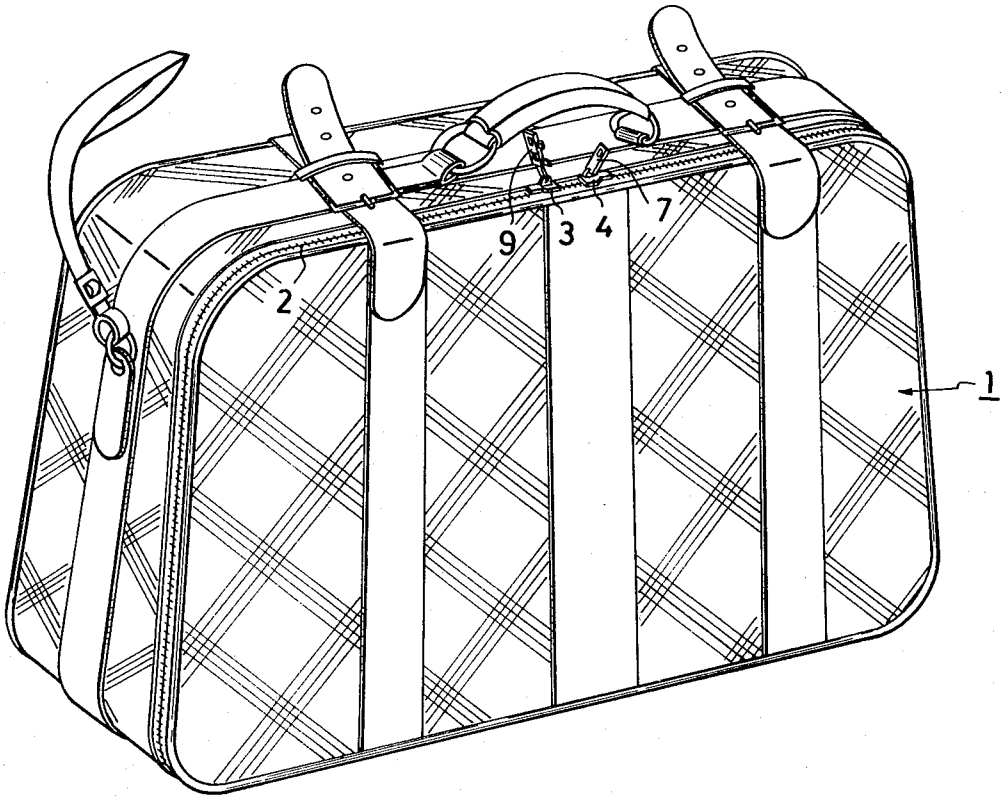
FIG. 1 is a perspective view of the suitcase using the lock of the present invention.
Figure 2:
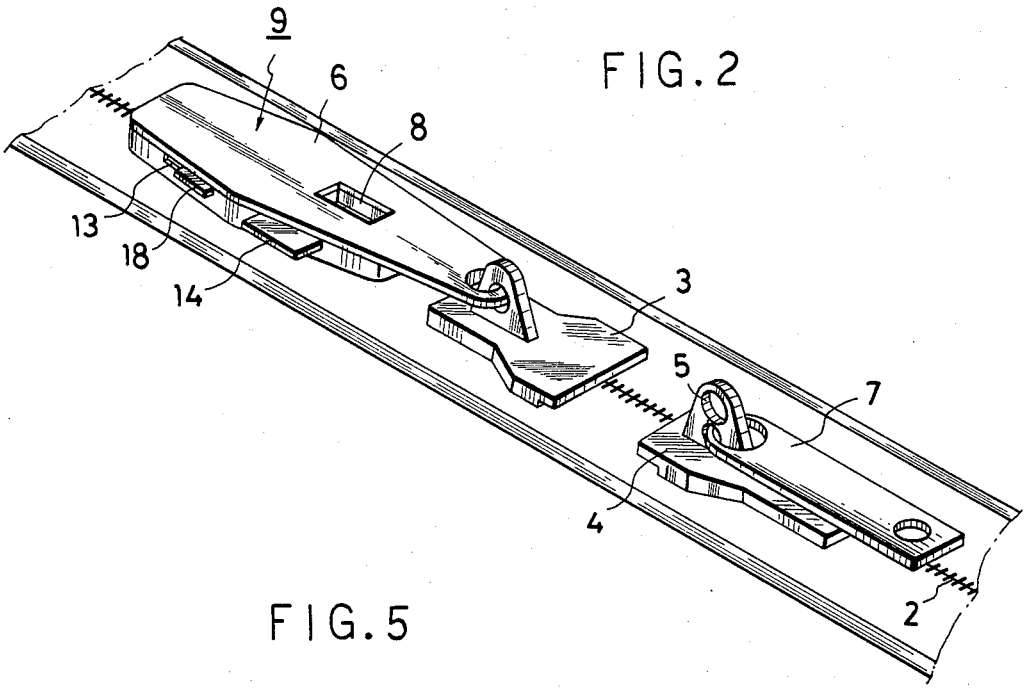
FIG. 2 is a perspective view of the lock of the present invention.
Figure 3:
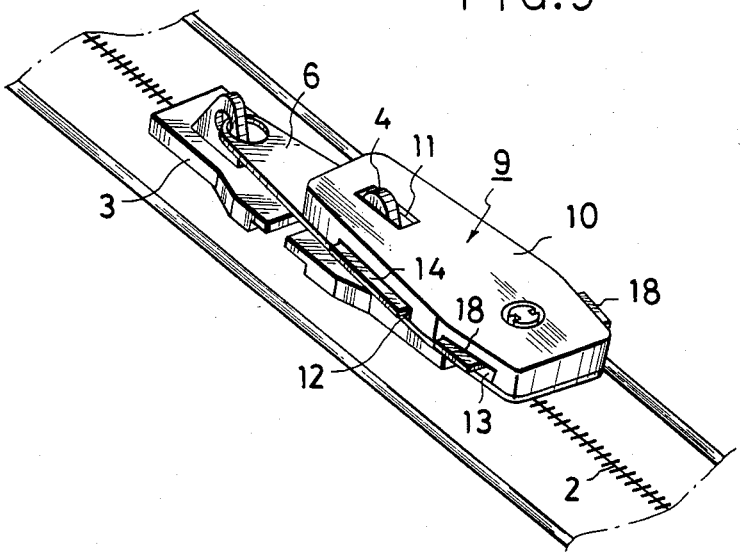
FIG. 3 is a perspective view illustrating the lock being locked.
Figure 4:
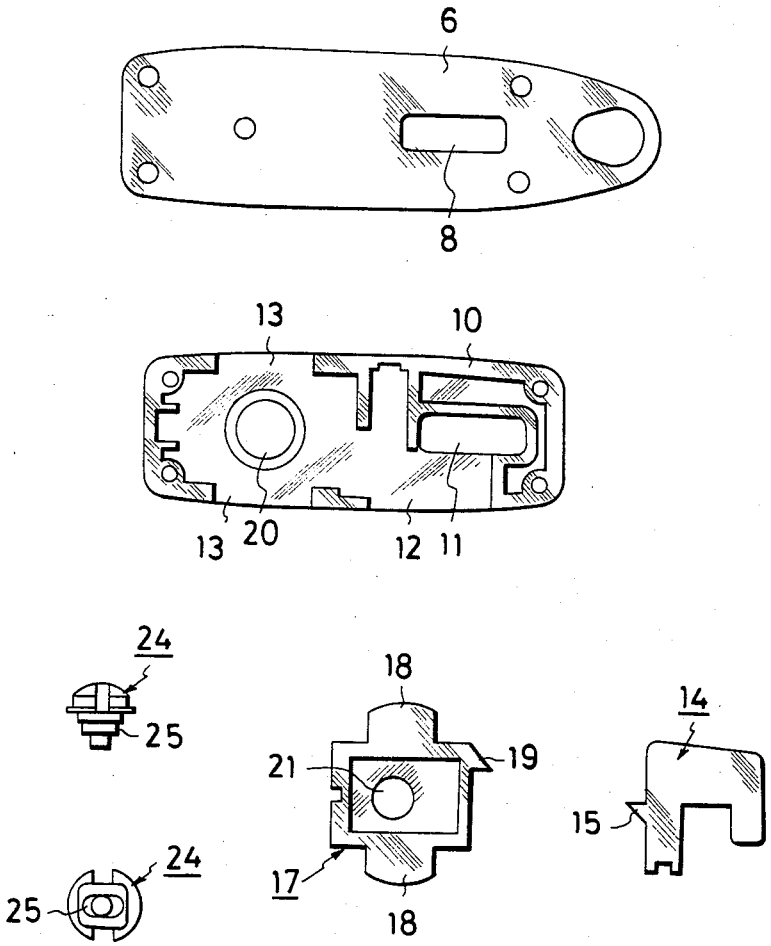
FIG. 4 is a drawing illustrating respective parts of the lock.

Referring now to an embodiment in accordance with the present invention by the drawing, a reference numeral 1 is a suitcase in FIG. 1 to FIG. 3, its opening portion is provided with a slide fastener 2 over nearly the entire circumstance of said suitcase, and two sliders 3 and 4 are installed for this fastener 2, said suitcase is constituted to be able to open and shut said fastener 2 by sliding of the sliders 3 and 4. Also, a rising head of slider 4 is provided with a penetrating hole 5 passing through the slider 4, and the slender plate-shaped catch plates 6 and 7 capable of pulling said sliders 3 and 4 are installed and fixed in these sliders respectively, further a long hole 8 capable of inserting a head of said slider 4 is drilled in the central portion of the one catch plate 6. Also, the lock 9 including a cover body and the like is installed and fixed incorporatedly on the upper surface of this catch plate 6.

Referring now in detail to the lock 9, in FIG. 2 to FIG. 7, reference numeral 10 is the cover body capable of covering the upper surface of said catch plate 6 and being fixed on said catch plate 6, the upper surface of its rear portion is provided with the hole 11 corresponding to the long hole 8 of the catch plate 6, and the one side surface corresponding to hole 11 is provided with the notched window 12, furthermore the slide windows 13 are drilled and formed on both sides in the tip portion of cover body 10 respectively. Reference numeral 14 is the hook plate bent in the shape of a hook, which slides to the direction crossing at right angles with an axial direction along the hole 11 of said cover body 10, and said hook plate is inserted in the cover body 10 so as to be able to project its head from the notched window 12. The rear surface of hook plate 14 is provided with a projection 15, said hook plate 14 formed so as to slip out from the notched window 12 by projection 15. Reference numeral 16 is the coil spring installed on an inside portion of the cover body 10, the tip portion of said coil spring comes in contact with the lower end of said hook plate 14, which is always energizing said hook plate 14 against the notched window 12.

Reference numeral 17 is the tray-shaped sliding plate, which is inserted so as to be able to slide to the axial direction of the cover body 10, both sides of said sliding plate are provided with boss-shaped knobs 18 respectively. The front of said sliding plate is provided with projection 19 capable of engaging with the projection 15 of said hook plate 14. The key hole 21 corresponding to the key hole 20 drilled at the tip portion in the upper surface of said cover body 10 is drilled in the base of said sliding plate. Reference numeral 22 is the coil spring installed at the inside of the tip portion of the cover body 10, which comes into contact with the rear surface of said sliding plate 17 and is always energizing sliding plate 17 against the side of said hook plate 14.

Reference numeral 23 is the specific plate spring that is received in the inside of said sliding plate 17 and is bent and swollen inside. The specific plate spring means includes a broken box-shaped plate spring which is composed of three remaining side leaves without the front, the rear leaves and the left side leaf. Reference numeral 24 is the axis capable of inserting the head in the key hole 20 of said cover body 10, and the elliptical plate 25 capable of forcibly opening the upper and the lower leaves of specific plate spring 23.

Figure 6:
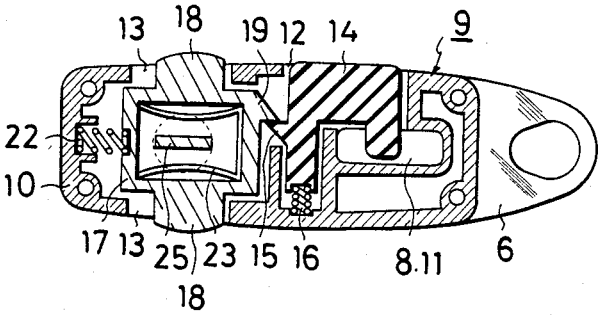
FIG. 6 is a sectional view illustrating the lock being locked temporarily.

Since the lock in accordance with the present invention has the structure mentioned above, as shown in FIG. 3 in case of use, the head of the slider 4 is inserted in the long hole 8 of the catch plate 6 which is fixed to the slider 3, and the hook plate 14 is slid by pressing the head of the hook plate 14 exposed from the notched window 12 of the lock 9 as shown in FIG. 6. A tip of the hook plate 14 is pierced through the penetrating hole 5 in the head of the slider 4, and simultaneously the movement of the hook plate 14 is stopped and the slider 3 can be temporarily connected with the slider 4 by adjoining mutually by means of the engagement of the projections 15 and 19.

Figure 5:
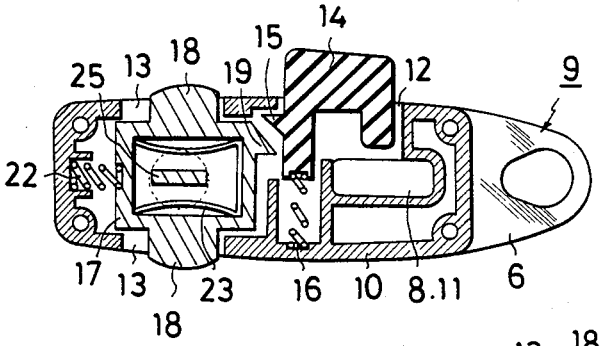
FIG. 5 is a sectional view illustrating the lock being unlocked.
Figure 7:
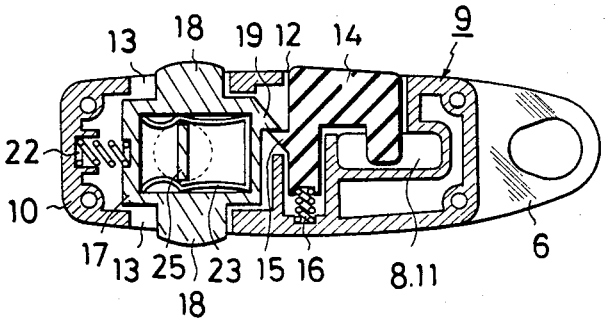
FIG. 7 is a sectional view illustrating the lock being locked.

Further, when the lock is fastened, as shown in FIG. 7, the specific plate spring 23 of the sliding plate 17 is opened forcibly with the elliptical plate 25 equipped on the lower portion of axis 24 by rotating said axis after the key is inserted in the key hole 20, therefore the slide of the sliding plate 17 is restricted, and the lock is fastened by fixing the engagement of the projections 15 and 19. When the lock is unfastened, as shown in FIG. 5, the axis 24 is returned in its original condition, the engagement of the projections 15 and 19 are released by sliding the sliding plate 17 with the boss-shaped knobs 18 of the sliding plate 17 in opposition to the coil spring 22. The hook plate 14 is moved by operation of the spring 16, the lock being unfastened by pulling out the tip of the hook plate 14 from the penetrating hole 5 of the slider 4.

By virtue of the lock in accordance with the present invention, the sliders are connected mutually and closely by inserting the head of the other slider in the hole of the catch plate as mentioned above, and said lock is constituted in one united body with the catch plate of the slider, consequently the present double-slider fastening lock has the following many characteristics that a handling of said lock is very convenient and an operation of said lock is simple without the danger of losing said lock, and a position at which fastens said lock can be decided everywhere along the suitcase because of using two sliders, also since said lock is fastened after the catch plate is engaged with the corresponding other slider, the two sliders can be connected mutually strongly and certainly without the danger that an unnecessary gap is formed between both said sliders or to a portion of the fastener by adjoining two said sliders. Further the lock is compact and its appearance is satisfactory, therefore said lock can be used for a small suitcase, and said lock can be produced on a large scale cheaply because of the simple structure.

What is claimed is:

1. A double-slider fastening lock comprising:

a first slider having a projecting head, a first catch plate connected to said first slider, a hole defined by said projecting head, a second slider, a second catch plate connected to said second slider, a hole defined by said second catch plate adapted to receive the projecting head of said first slider, a cover body fixedly mounted on one side of said second catch plate, said cover body defining a hole corresponding to said hole defined by said second catch plate, a hook-shaped plate including a projection, said hook-shaped plate being slidably mounted in said cover body and said hook-shaped plate adapted to slide across said hole of said cover body and to slide perpendicular to the longitudinal axis of said hole of said cover body, a tip of said hook-shaped plate adapted to pass through said hole of said projecting head, and a sliding plate slidably mounted in said cover body, said sliding plate including a projection and said sliding plate adapted to slide in a direction parallel to the longitudinal axis of the cover body, said projection of said sliding plate engaging said projection of said hook-shaped plate to lock said first slider and said second slider together when said tip of said hook-shaped plate passes through said hole of said projecting head when the projecting head extends through the hole defined by said second catch plate and the hole defined by said cover body.

2. A double-slider fastening lock according to claim 1, wherein said cover plate includes windows defined by the sides of the cover plate and said sliding plate includes opposing knobs projecting through said windows.

3. A double-slider fastening lock according to claim 2, further comprising two springs mounted in said cover body, one spring biasing said hook-shaped plate in said direction perpendicular to the longitudinal axis of the hole of said cover body and one spring biasing said sliding plate in said direction parallel to the longitudinal axis of the cover body.

4. A double-slider fastening lock according to claim 3, further comprising an opening defined by said sliding plate and a plate spring located in said opening adapted to releasably lock said sliding plate in engagement with said hook-shaped plate.

* * * * *